United States Patent [19]

Guery et al.

[11] Patent Number: 4,644,311

[45] Date of Patent: Feb. 17, 1987

[54] POLARIZED ELECTROMAGNET WITH SYMMETRICAL ARRANGEMENT

[75] Inventors: Jean-Pierre Guery, Bezons; Jacques Olifant, Nanterre, both of France

[73] Assignee: La Telemechanique Electrique, France

[21] Appl. No.: 767,386

[22] Filed: Aug. 19, 1985

[30] Foreign Application Priority Data

Aug. 20, 1984 [FR] France ..... 84 12975
Nov. 19, 1984 [FR] France ..... 84 17829

[51] Int. Cl.[4] ..... H01F 7/08
[52] U.S. Cl. ..... 335/230; 335/238; 335/273
[58] Field of Search ..... 335/229, 230, 234, 238, 335/273, 274, 279

[56] References Cited

U.S. PATENT DOCUMENTS 3,792,390 2/1974 Boyd ..... 335/234 X
4,319,211 3/1982 Ueda et al. ..... 335/229

*Primary Examiner*—George Harris
*Attorney, Agent, or Firm*—William A. Drucker

[57] ABSTRACT

A symmetrical monostable polarized electromagnet is provided in which a fixed permanent magnetic structure and a mobile magnetizable structure passing through the coil are dimensioned so that the starting movement from the rest position of said mobile structure for given ampere turns may be produced with certainty through adjustment of air gaps, whereas return from the working position is provided by the presence of second air gaps and/or by the action of a variable slope recall spring.

The invention reduces particularly the remanent holding effects appearing in the working position as well as the power required for supplying the coil for causing a change of state thereof when the coil is at rest.

22 Claims, 18 Drawing Figures

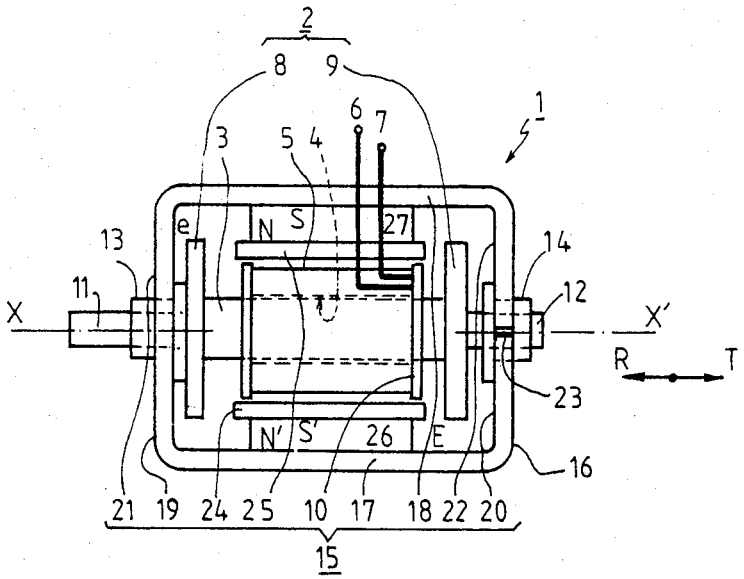
FIG. 1
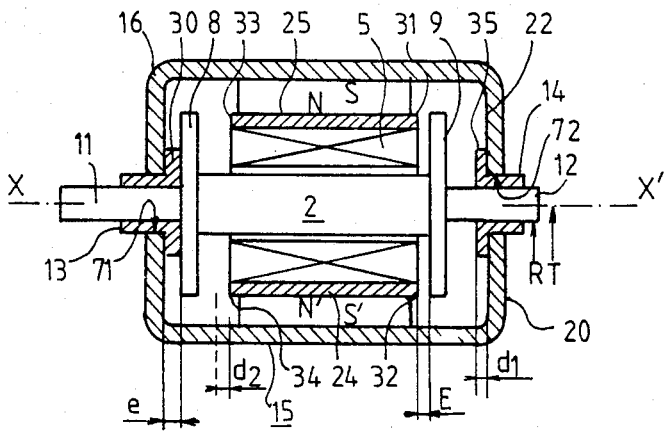
FIG. 2
FIG. 3
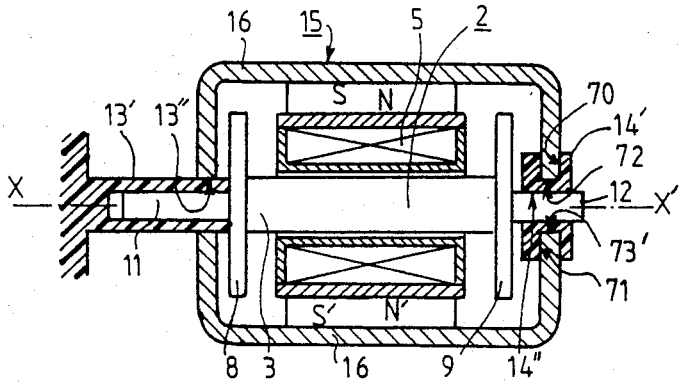
FIG. 4
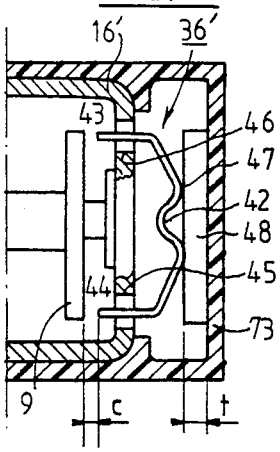

FIG. 5
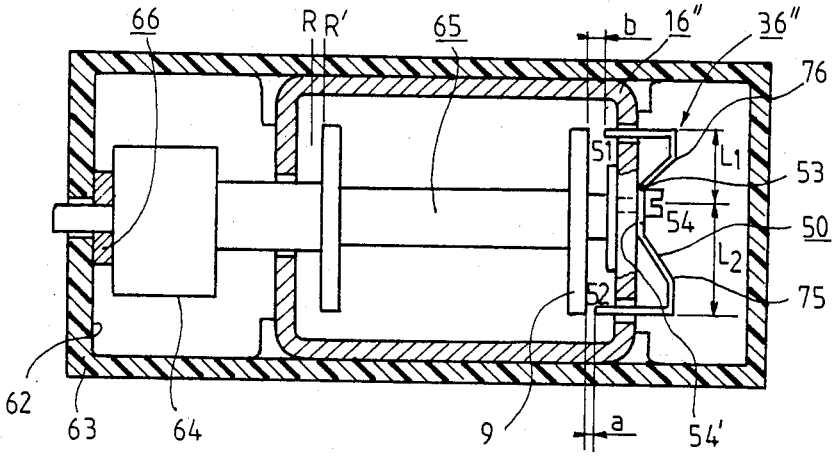
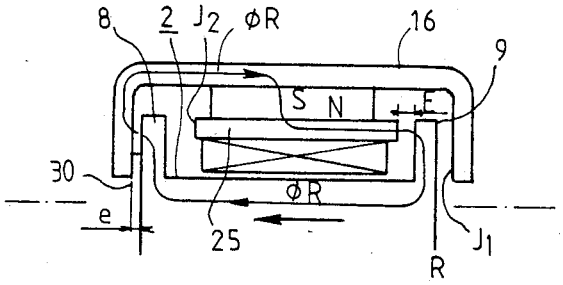
FIG. 10
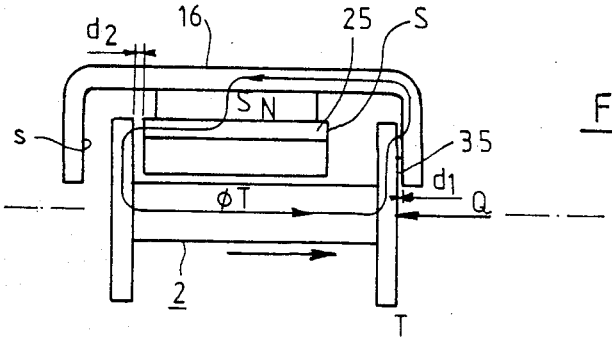
FIG. 11

POLARIZED ELECTROMAGNET WITH SYMMETRICAL ARRANGEMENT

BACKGROUND OF THE INVENTION

1. Field of the Invention

The invention relates to a polarized electromagnet comprising:

on the one hand, a first magnetizable structure formed by a core placed longitudinally in the axis of symmetry of a coil adapted for receiving a DC current and by two widened pole portions integral with the core which extend transversely outside the coil;

on the other hand a second permanent magnetic structure formed by a second longitudinal magnetizable piece which has two transverse extensions directed towards the axis and which is parallel to a third magnetizable piece closer to the axis and to which it is connected by a permanent magnet with transverse magnetic axis;

opposite ends of this third piece and regions of these extensions adjacent thereto being separated by two air gaps placed substantially along a longitudinal direction so that attraction, respectively repulsion forces of the same longitudinal direction are developed between each of the respective widened pole portions placed in each of the air gaps and the second structure.

2. Description of the Prior Art

Such polarized electromagnets which are in particular applicable to controlling switching apparatus such as relays or contactors and which are known from the patent FR No. 2 358 006 may of course have a symmetrical construction about the single natural axis of symmetry formed by the axis of the coil.

It is clear that the symmetrical development of such a structure causes well known effects to appear; thus, with such a construction, the attraction forces may certainly be doubled by placing their resultant on the common axis of symmetry and the whole of the pieces which form the magnetic circuit may be made heavier without for all that changing the nature of the first results obtained, namely: a relative rectilinear movement of the first and second structures parallel to the axis complete closing of the flux of the magnet in each of the two opposite stable positions and reduction of the magnetic interferences obtained by orientating the axis of the magnet perpendicularly with respect to that of the coil.

In such an electromagnet, the repulsion and attraction forces which appear between the widened pole portions and the extensions on the one hand and between the widened pole portions and the ends on the other, communicate to the two structures forces in opposite directions, the use of the useful direction of which is in fact a simple matter of choice; each of the two possible choices give only clearly foreseeable results whose contents may at any time be used depending on the needs. Obtaining these foreseeable results in no wise modifies moreover the presence and use of the first results which are mentioned above.

French patent No. 1 603 300 which relates to a polarized electromagnet in which the magnetizable piece is mobile through the coil further mentions a possible use of such symmetrical arrangements which does not cause for all that a change to appear in the nature of the physical phenomena governing the operation.

In connection with the foregoing discussion, there may also be mentioned the additional faculty which a user may take advantage of by simultaneously giving to the first and second structures particular freedoms of movement whose relative amplitude is put to use by a common mechanism, such as the principle thereof is illustrated for example in patent DE No. 1097 563.

The measures which on the other hand may be taken for adapting the known behavior of an electromagnet to a particular class of apparatus or functions must however be more carefully examined to the extent that certain prescriptions or precautions specific to these apparatus respectively to these functions sometimes force the user either to adapt the physical behavior of the electromagnet so as to obtain well defined results or else to choose, in an overall region of operation, a region particularly well adapted to obtaining such results.

Thus, a great interest, which is justified by the constant search for safety and by that of more and more reduced consumption is attached to the automatic return to the rest position of a relay or contactor independently of the state of wear of its contacts and its movement towards the working position with reduced coil ampere turns; the gradual reduction of the dimensions of such contacts, which has an influence on the overall forces to which the mobile armature is subjected at the time of de-energization of the coil, may in fact cause one to fear the effects of remanent attraction which is frequently observed in polarized electromagnets.

The same fear of seeing the intensity of the resilient recall forces of the armature reduced and so of leaving an unfavorable overall attracticn force in existence in the rest state, may result from the efficiency reducing character which may be introduced by a transmission lever when, with a small stroke of the mobile armature, it becomes necessary to place a movement step-up lever between the armature and the mobile contacts of a switching apparatus whose own stroke must be greater than the preceding one.

The invention provides therefore a polarized electromagnet having a symmetrical lay out which uses elements corresponding to the above mentioned construction, improvements designed to reduce the power required by the coil for ensuring its change of state when this electromagnet is at rest and to allow this electromagnet to be adjusted so that the mobile assembly starts to move on the rising voltage.

SUMMARY OF THE INVENTION

In accordance with the invention, the aim sought is attained because:

in the rest position of a first mobile magnetizable structure symmetrical with respect to the axis of the coil, the widened pole portions do not come into contact with the second symmetrical magnetic structure.

the partial reluctance established between a first widened pole portion and the third pieces being greater than the partial reluctance established between the second widened pole portion and the second piece of the second structure, so as to form an overall reluctance at rest.

these two partial reluctances being adjusted simultaneously by means of an air gap adjustment member which defines, through a small relative movement of the two structures, the effective rest position in which the movement of the mobile structure takes place, when the coil is supplied with power on the rising voltage.

A secondary aim of the invention, within the scope of complementary measures, is to reduce the remanent holding effects which may appear in the working position of the mobile structure, particularly when this structure is associated with electric contacts whose wear modifies the overall resilient return forces.

BRIEF DESCRIPTION OF THE DRAWINGS

The invention as well as the measures designed to keep or respectively to facilitate the obtainment of the desired results will be better understood from reading the following description with reference to the accompanying Figures and in which:

FIG. 1 shows in an external elevational view, an electromagnet according to the invention;

FIG. 2 shows an axial section in elevation, of the electromagnet of FIG. 1;

FIG. 3 shows, in an axial section in elevation, a second embodiment of an electromagnet according to the invention;

FIGS. 4, 5, and 9 illustrate two embodiments of a return spring with variable flexibility which is effective in the working position of the electromagnet;

FIGS. 10 and 11 show schematically the paths followed by different fluxes for opposite positions of the armature;

DESCRIPTION OF THE PREFERRED EMBODIMENTS

Figure 6:
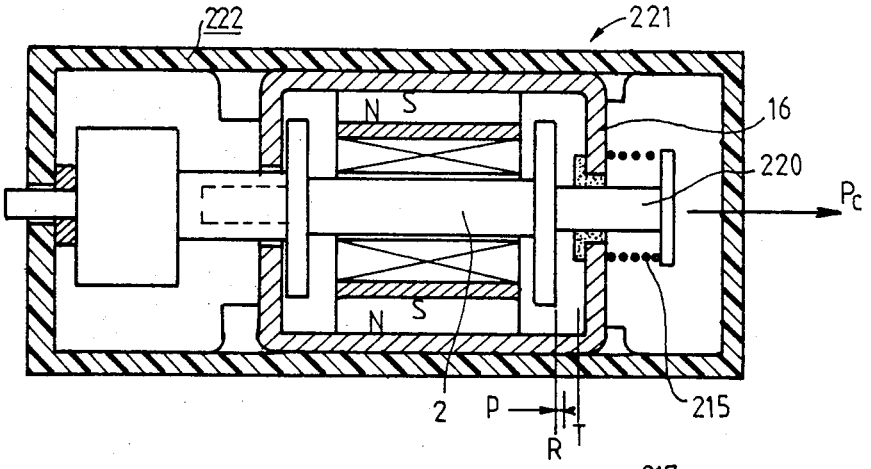
FIGS. 6, 7 and 8 show how a compensation spring may be used for facilitating the start of the movement of the mobile assembly of the electromagnet towards the working position.

A polarized electromagnet 1 comprises a first magnetizable structure or armature 2; which is formed on the one hand by a magnetizable core 3 placed longitudinally for sliding in the axis of symmetry XX' of the inner bore 4 of a coil 5 adapted for receiving or not at its terminals 6, 7 DC or rectified current and, on the other hand, by two magnetizable widened pole portions 8, 9 which are integral with core 3 and extend transversely with respect to axis XX'. The bore 4 forms part of a carcase 10, the constructional details of which are given hereafter.

This magnetizable structure, which will here play the role of armature or mobile assembly of the electromagnet, has two opposite extensions 11, 12 which pass through two bearings 13, 14 made from an amagnetic material, whose function is either to ensure the whole of the guiding of the axial or longitudinal movements of core 3, or to ensure such guiding in combination with that which may be obtained by a snug fit of this core in bore 4; in a preferred embodiment the core moves without touching the surface of bore 4, through a strict alignment of the axis of bore 4 (greater than the diameter of the core) and of the axis of two bores 71, 72 of the piece holding these bearings 13, 14, see FIG. 2.

A second structure 15 which is permanently magnetized comprises first of all a second magnetizable piece 16 having in this example two longitudinal portions 17, 18 parallel to axis XX' and two opposite transverse extensions 19, 20 respectively 21, 22; in the illustrated embodiment, these portions and extensions form part of the same flat metal part, stamped and bent so as to form a substantially rectangular frame whose junction line is preferably situated on axis XX', for example at point 23.

This frame, which may advantageously support bearings 13, 14 has an axis of symmetry which merges with the axis XX' of coil 5 which it surrounds, see FIG. 2. In a preferred embodiment, the function of bearing 13 will be fulfilled by a cylindrical plastic material piece 13' which is fitted onto end 11 and slides in a bore 13'' of piece 16 with axis XX', whereas bearing 14 is supported by a plastic material piece 14' which defines bore 14'' and has two opposite and parallel throat portions 70, 71 which fit onto the opposite edges of an open groove 72, 73 placed on each side of junction 23.

This second structure 15 further comprises two third magnetizable pieces 24, 25 parallel to axis XX' which are closer thereto than piece 16 and which are each connected to a parallel portion 17, 18 by two permanent magnets 26, 27 whose NS, N'S' magnetic axes are transversal.

In the rest position R of armature 2, which is shown in FIGS. 1 and 2, a collar 30 of bearing 13 serves as abutment for the widened pole portion 8 while forming between this latter and piece 16 an air gap e, whereas the widened pole portion 9 is then separated from ends 31, 32 of pieces 24, 25 by a larger air gap E. This rest position is a stable position because of the closure of the flux $\phi_R$ of the permanent magnets which is established through the core, the air gaps and piece 16 in the absence of current in the coil, see FIG. 10.

In this rest position, the magnetic holding force due to the permanent fluxes, depends on the inductions in the air gaps E and e whose own facing surfaces are S, respectively s. The induction of the air gap E is greater than that present in the other air gap, because of the low value which S takes on here, since this value results from the facing relation of two surfaces one of which (that of piece 25) is an end surface. The reluctance $R_2$ of the air gap E is therefore greater than that $R_1$ of the air gap e.

The result of these differences is that a small axial movement of the armature, which will take place in the vicinity of the theoretical rest position for reasons which will be given further on, causes a relatively large variation of the magnetic holding force allowing adjustment thereof, the need for such an adjustment is justified more especially when it is desired that the electromagnet changes state for a given supply voltage.

Figure 12:
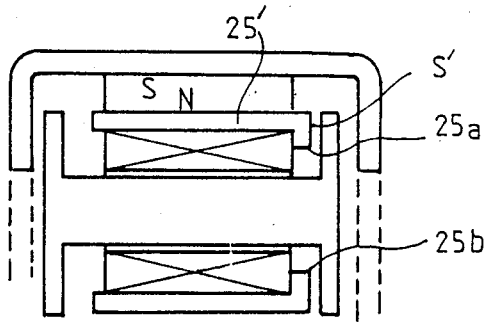
FIG. 12 illustrates a possible form of adjacent pole surfaces of the coil.

If widened pole portions such as 25*a*, 25*b* were placed at the ends of piece 25', see FIG. 12, the surface S' would be larger and the sensitivity of adjustment of the holding force would be reduced.

When a current of suitable direction flows through the coil, a flux $\phi_B$ of a direction opposite $\phi_R$ in the core will cause magnetic poles to appear of the same sign in the air gaps E and e; if piece 16 is fixed, and if the armature is mobile, this latter may then move rightwards because of the repulsion forces created by the signs of these poles; if armature 2 is fixed and if piece 16 is mobile, this latter will move leftwards; if two pieces 16 and 2 are mobile, a relative movement will naturally be established therebetween.

The appearance of magnetic poles of the same sign which was mentioned above is accompanied by the appearance of magnetic poles of opposite signs on the one hand on the widened pole portion 8 and ends 33, 34 of pieces 24, 25 and on the other hand on the widened pole portion 9 and extensions 20, 22; the result is the development of attraction forces which will combine and move the armature rightwards from the position shown in FIG. 10 if it is mobile.

The rightward movement of the armature continues until the widened pole portion 9 comes into abutment, in the working position T shown in FIG. 11, against a collar 35 of bearing 14.

For this position T, a first air gap $d_1$ materialized by the thickness of the collar 35 and a second air gap $d_2$ see also FIG. 2, will be placed in the path of the flux $\phi_T$ which is then established: this working position T which may be stable in the absence of current as before and for the same reason, may also be unstable when the current disappears if forces Q of sufficient size and of suitable direction are exerted on the armature.

The partial reluctances due to the air gaps $d_1$ and $d_2$ may, with respective surfaces $J_1$, $J_2$, be equal or different, as will be seen further on; the bistable or monostable behavior of the electromagnet depends moreover on the choice of the ratio of the overall reluctances $R_r$ at rest and $R_t$ under working conditions.

Figure 13:
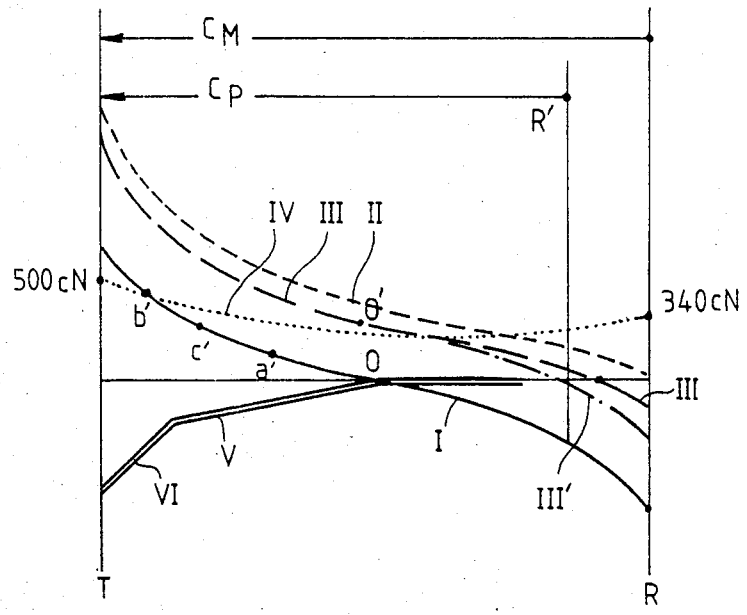
FIG. 13 shows a multiplicity of curves indicating forces exerted by different members of the electromagnet between the rest posiition and the working position.

The evolution of the overall forces communicated to the armature (i.e. the sum of the attraction and repulsion forces) is shown in particular in the diagrams of FIG. 13 where the curve I represents the evolution of the forces to which the armature is subjected when it is mechanically moved without energization of the coil; curves II and III show the attraction forces which are applied to the armature when the coil is fed with its nominal voltage and respectively with the rising voltage.

Because of the above mentioned arrangements, illustrated in FIGS. 10 and 11, this rising voltage may be adjusted with good sensitivity by small axial movements of the mobile armature, which does not appreciably reduce the useful stroke thereof.

The portion of curve III' of FIG. 13 shows how curve III would evolve if the overall reluctance $R_r$ established by the air gaps e and E and the surfaces S and s for a given position, were equal to that $R_t$ of the air gaps $d_1$ and $d_2$ for a position axially symmetrical with the preceding one with respect to a central position O; it can be seen that curve III has with respect to the mean point O' a more pronounced disymmetry than that of the portion III', for conferring a monostable property on this electromagnet.

Curve IV shows the useful attraction forces which have a non rectilinear trend whose final value in position T is about one and a half times that developed in position R. This curve results from the difference of the attractions shown by curves I and III.

Curves IV and V show the evolution of the resistant forces which may be applied to the armature by a double slope spring from a substantially central position as far as the working position T.

Finally, the position of the vertical straight line referenced R', shows the effect produced by mechanical movement of the position of the armature for adjusting the rest position; the means used for such adjustment will be described hereafter.

In each of the two positions R or T, see FIGS. 2 and 10, 11 it is clear that the systematic presence of residual air gaps e, E and $d_1$, $d_2$ combine in reducing the remanence effects which would be to be feared with flux closures caused by direct contact of the widened pole portions 8, 9 against pieces 16, respectively 24, 25.

Figure 16:
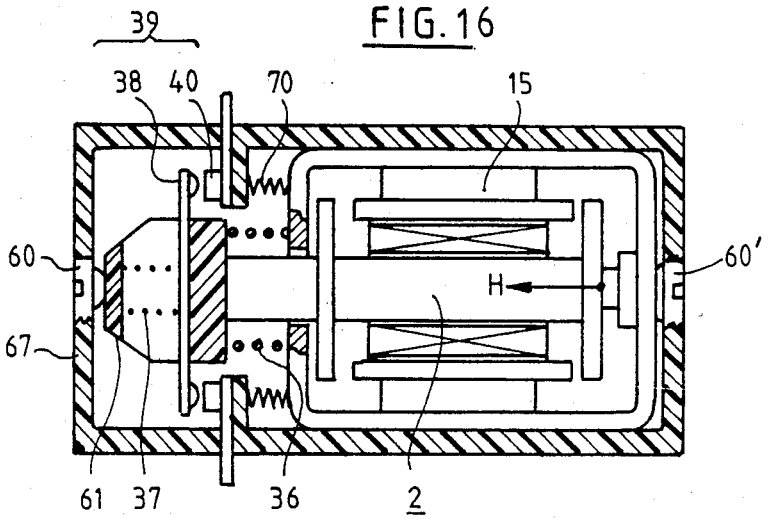
FIG. 16 shows, in a simplified axial section, a contactor apparatus equipped with means for adjusting the rest position.

The resistant force Q which is developed in the working position T, of a corresponding direction may also result from the presence of return springs such as 36 and contact pressure springs such as 37 if the armature is mechanically connected to one or more mobile contacts 38 cooperating with fixed contacts 40 of switches such as 39, such as when the electromagnet is used in a relay or a contactor, see FIG. 16.

It is clear that a monostable property may be also conferred on an electromagnet whose structure allows a bistable property, by combining the existence of disymmetric reluctances at rest and in the working position and the presence of resilient return means which are effective in the working position.

In an interesting embodiment of a monostable electromagnet, the return spring 36', see FIG. 4, respectively 36'', see FIG. 5, will have a non linear characteristic so as to best adapt to the non linear trend of the magnetic forces which are exerted on the armature when this latter moves from position R to position T.

The evolution of the magnetic forces exerted on the armature, which is shown in the diagram of FIG. 13, has in the vicinity of the working position T a parabolic trend which connects progressively to a rectilinear portion ending at a mean position O where the forces exerted on the armature are zero.

Figure 14:
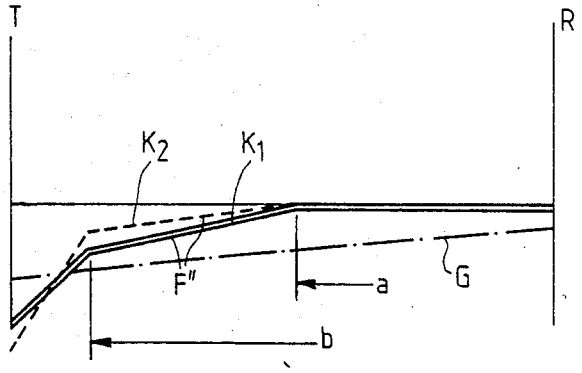
FIGS. 14 and 15 show the evolution of the resistance forces imparted to the armature by two variable flexibility springs.
Figure 15:
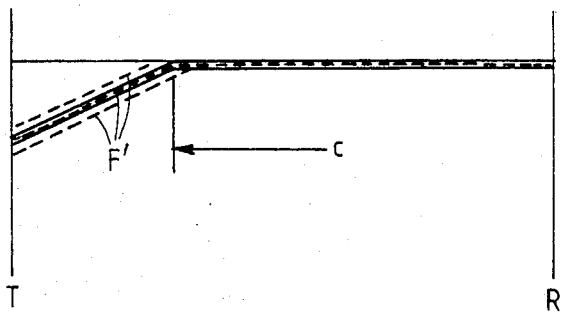

Consequently, an increasing rectilinear or polygonal trend F' or F'', such as shown in FIGS. 15 and 14, may be given to the characteristic of the spring 36', respectively 36''.

The characteristic F' may be obtained for example by using a resilient amagnetic blade 42, see FIG. 4, which is placed externally of piece 16' and whose two ends 43, 44 pass through openings or clearances 45, 46 therein, whereas a central region 47 is held away from case 73 by a certain distance t which may be adjusted, by means of a fixed stop or wedge 48 bearing thereon.

The widened pole portion 9 which is separated from ends 43, 44 by a distance c will then have to effect a previous stroke c where no force is met before the beginning of a resilient reaction of blade 42 takes place and before a progressively increasing force F' is exerted; the slope of the resilient forces will here be substantially that of curve I of FIG. 13 at point c', see also FIG. 15; the effect of adjusting stroke c (or the thickness t), is shown with a dotted line in the same Figure.

The characteristic F'' may be obtained for example by using a resilient amagnetic blade 50, see FIG. 5, which is placed externally of piece 16'', and whose two ends 51, 52 pass through openings or clearances 45, 46 whereas an offcentered region 53 of this blade is fixed (for example by means of a screw 54 on piece 16'') to define different deformable resilient lengths $L_1$, $L_2$.

If distances a and b separate the widened pole portion 9 from ends 51, respectively 52, the appearance of resistant forces F'', having successively two growth slopes, will allow even more accurate adaptation to the growth of the magnetic forces. A relative adjustment of the slopes may be provided by a transverse translational movement of blade 50 which is made possible because of the presence of an oblong opening 54 for modifying the ratio $L_1/L_2=K$; the slopes of the resilient forces successively met with and shown in FIG. 14 will be substantially equal to the slopes of two tangents to curve I of FIG. 13, passing through points a' and b'; the effect of the adjustment is shown on the broken line curve of FIG. 14 for two values $L_2/L_1=K_1$ and $L_2/L_1=K_2$.

Figure 9:
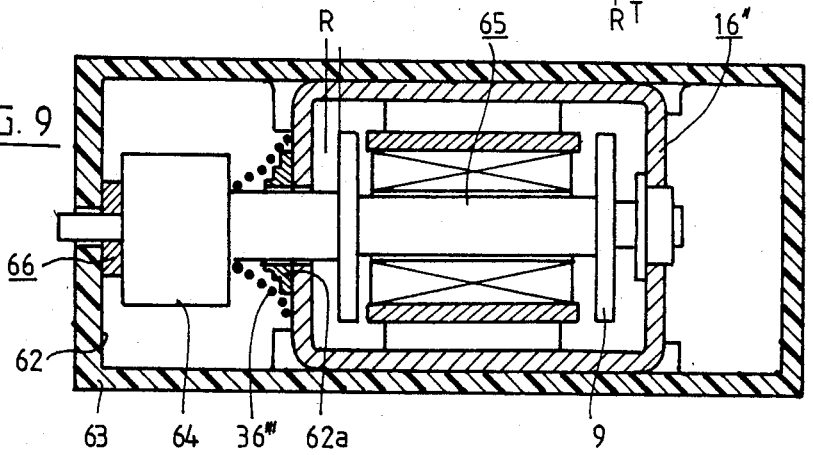

In another embodiment of a spring with variable slope having the same function and shown in FIG. 9, where the parts having the same function bear the same references, a helical compression spring is used with turns of variable diameters 36''', whose widest turns bear progressively during deformation thereof against a stepped bearing surface which forms for example an integral part of an auxiliary molded piece 62*a*.

An electromagnet in accordance with the invention may, within the scope of application to a contactor be adjusted for reliably ensuring, on the one hand, passage thereof from the rest position R to the working position T, with minimum given energization of its coil and, on the other hand, a smooth reverse movement thereof when the coil is no longer energized while taking into account possible wear of the contacts.

It is in fact known that the wear of the contacts after a large number of operations, causes slight decompression of the contact pressure springs resulting in a reduction of the return forces in direction H to the work position to which the armature is subjected in the work position; the total forces cannot of course escape from the variations resulting from such wear; these variations remain however small because of the presence of a spring 36' or 36'' replacing the conventional return spring 36 whose elastic characteristic G is shown in FIG. 14.

So that the first adjustment may be conducted suitably, the armature is constructed so as to have a stroke $C_M$ slightly greater than that $C_p$ which is provided for actuating the contacts of the switches, See FIG. 13.

With the coil fed with the minimum current prescribed by the standards, the armature must then be artificially given a new rest position R' (from the position R in which the widened pole portion 8 would bear on collar 33 if this latter were present) by moving for example an adjustable mechanical stop 60, installed in case 67 and on which the contact holder 61 or a piece integral therewith bears in the rest position, to a new position R' in which the change of state takes place, see FIG. 16.

It is clear that, in this type of adjustment, the whole of the permanent magnetic structure 15 could also be moved in the reverse direction with respect to case 67 of the contact by means of an adjustable stop 60' acting against the return effect of a spring 70.

Another method, see FIG. 5, consists in placing between a fixed surface 62 of case 63 and the mobile contact holder 64 connected to the armature 65 a removable spacer 66 having an appropriate thickness for defining the effective rest position R'.

The possibility of mechanical adjustment of the return forces in the work position by means of a spring 36' or 36'' mentioned above, is preferable to that of magnetic adjustment which would require either the size of the air gap $d_1$ or the surfaces of the pieces which define it, or else the useful flux of the magnet to be modified in the working position.

In fact, the first of these adjustment methods would reduce the useful stroke too much, whereas the second would be uneconomical to implement, and the third method of adjustment would modify the value of the ampere turns required for pulling the armature or would require the placing of permanent magnets developing a more or less intense flux. Of course, remote modification of the magnetic properties of the magnets may still be used if the lay out of the two structures lends itself to such a process.

It is also possible to dispose between piece 16 and one of the pieces 24, 25 (or both) either reluctance adjustment means, or permanent magnets suitably orientated so as to reduce $\phi_T$.

The form of the evolution of the attraction force which the armature undergoes in the vicinity of the working position T results from the ratio of the reluctances established by the residual air gaps $d_1$ and $d_2$ and the magnetic surfaces placed opposite.

When an electromagnet is to be provided for actuating contactor switches which may be formed by opening switches and closing switches, it is necessary to take into account the effect of the drive forces which are communicated in a positive direction to the armature over a part of its course by the contact pressure springs of the opening switches.

It follows that, when a contactor has the maximum number of closing switches, it may be necessary to compensate for the absence of said drive forces.

This compensation may be provided in a contactor 222 using a polarized electromagnet 221 such as described above by providing a spring 215, see FIG. 6, which is for example advantageously placed outside the magnetizable frame 16, which exerts on the mobile armature 2 a resilient force Pc directed in the direction of the arrow, and which only acts along a fraction p of the whole of the stroke of this armature measured from the rest position R. The effect of such a spring is moreover useful for providing a clean cut movement of the armature from the rest position and for a supply voltage of the coil slightly less than the nominal voltage.

Spring 215 which is illustrated in FIG. 6 is preferably a helical spring whose slope is variable, for example because of the arrangement of turns at variable pitches which come progressively into contact with each other so that the stiffness of the spring is higher when it is compressed.

Figure 7:
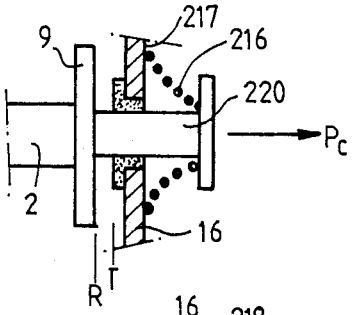

In FIG. 7 has been shown a helical spring 216 having the same properties, but here the reduction of the useful length results from winding the turns about a conical surface, so that the largest diameter turns come to bear progressively on surface 217, possibly stepped, of the magnetizable piece 16.

Figure 8:
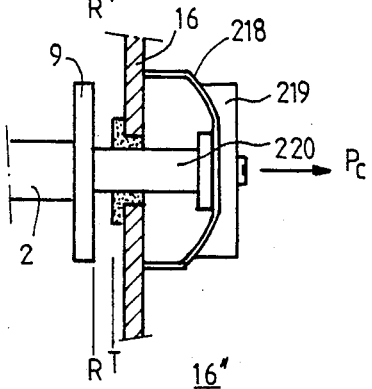

In FIG. 8 has been shown a spring blade 218, whose useful length decreases when the compression increases because of the progressive application of its surface against a transverse ramp 219 integral with an extension 220 of the core 2.

In all these embodiments, the variable flexibility spring is associated with an extension 220 of the core 2 which projects outside the magnetizable piece 16 on the side related to the working position T. The remainder of the components are comparable to those in FIG. 5.

Figure 17:
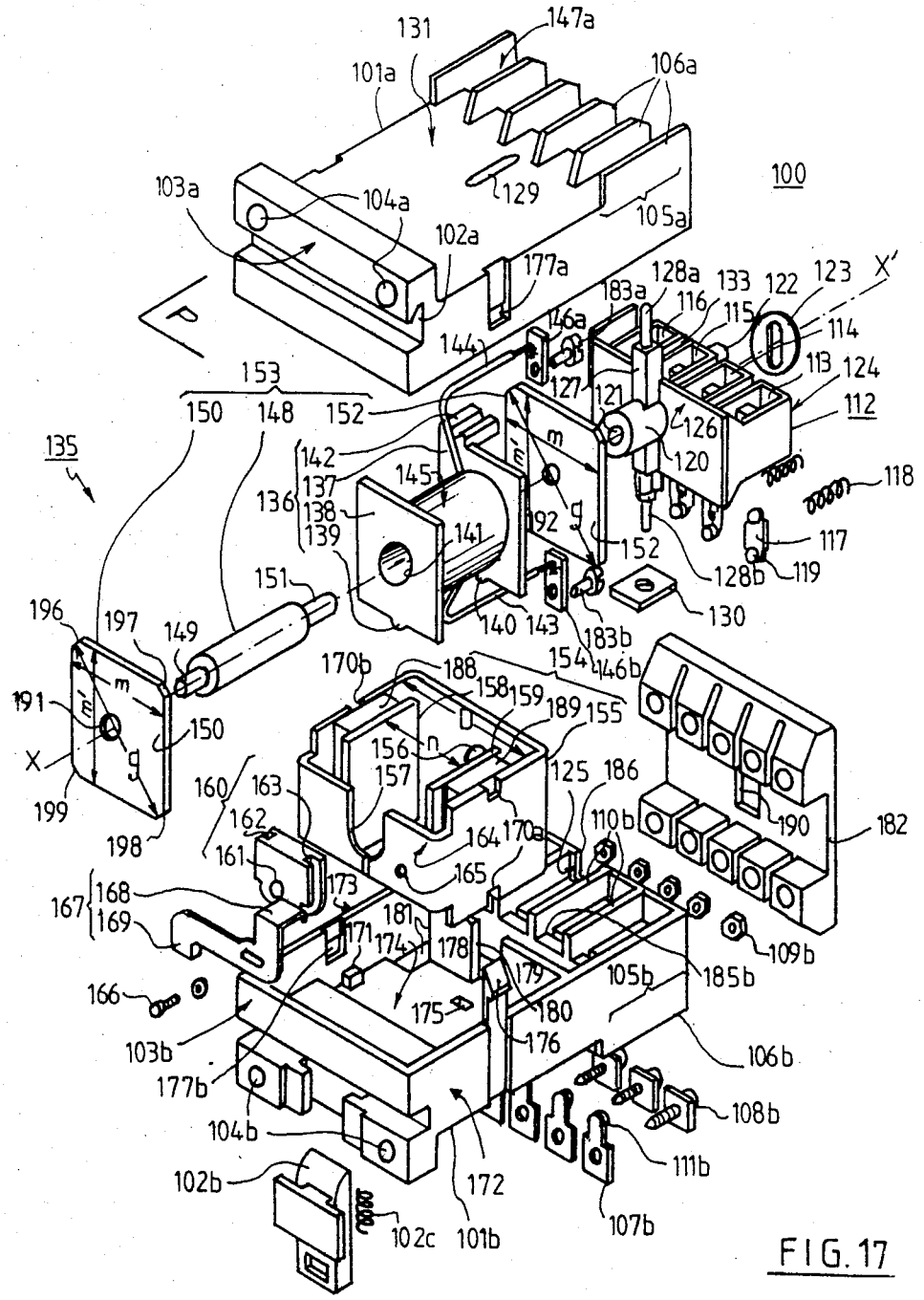
FIGS. 17 and 18 illustrate, in perspective views, a first and second embodiment of a contactor apparatus putting into practice respectively two variants of an electromagnet in accordance with the invention.

A contactor apparatus 100 using a polarized electromagnet in accordance with the invention derived from the one shown in FIG. 5, and which is shown in FIG. 17, comprises a casing 101 formed by the association of two half cases 101*a* and 101*b* substantially symmetrical with respect to a joint plane P.

Each of these half cases has in a lower external region securing means 102*a*, 102*b*, 102*c* for fixing it to a standard extruded section and a support base 103*a*, 103*b* for fixing it to a plate by means of fixing holes 104.

Upper external regions 105*a*, 105*b* of the half cases have isolating walls such as 106*a*, 106*b* between which are engaged fixed contact supports such as 107*b*, as well as terminal screws with bridge connectors such as 108*b* which pass through these supports and cooperate with nuts such as 109*b* placed therebehind.

Upper internal regions of these half cases have dividing walls such as 110*b* which extend the preceding ones so as to separate adjacent fixed contacts 111*b* which penetrate therebetween through slits 185*b*.

A mobile contact holder 112 which moves along an axis XX' passing through plane P perpendicularly to base 103, comprises a multiplicity of isolated windows 113, 114, 115, 116 inside which are disposed contact bridges such as 117 and the pressure springs thereof such as 118. These contact bridges have contact studs 119 which cooperate with the fixed contacts 111*b*.

The contact holder has, along axis XX', a cylindrical extension 120 directed towards the base and having a bore 121, and on the opposite side, a stud 122 which may receive an adjustment washer 123 having a thickness chosen for defining the rest position R'. This washer is nipped in the rest position between the flat upper surface 124 of the contact holder 112 and a bearing surface 125 of the half case 101 through which stud 122 may pass through opening 186.

The contact holder also has on its lower surface 126 a cross piece 127 one end of which carries one or more coupling studs such as 128*a*, 128*b* which are adapted for passing through oblong openings such as 129 in half case 101*a*, for communicating movements to auxiliary apparatus placed outside the case.

Plates such as 130 which are engaged on these studs slide against the internal face of the walls 131 of the case for covering the openings 129 and providing sealing.

Windows 113... 116 are separated by grooves such as 133 in which the dividing walls 110 are engaged for completing the isolation of adjacent switches using each members 107, 117.

The electromagnet 135 of the invention comprises a coil carcase 136 having cheeks 137, 138 with centering studs 139, 140, a bore 141 and two longitudinal columns such as 142 for guiding the output wires 143, 144 of winding 145 to the upper part of the case; these wires comprise at their ends screw terminal pieces 146*a*, 146*b* which will come into position in two housings in the half cases such as 147*a*.

The cylindrical core 148 which passes through bore 141 is associated by a clamping relation at its lower end 149 with a hole 191 in a first plate 150 and at its upper end 151 with a hole 192 in a second plate 152; this end 151 is also associated by a clamping relation with the bore 121 of the contact holder. Pieces 148, 150 and 152 form the mobile magnetizable structure 153. Plates 150, 152 have widths m and m' and diagonals g.

The permanent magnetic structure 154 comprises:

a magnetizable metal piece 155 bent into the shape of a rectangular frame with an internal width D greater than g, which comprises an annular bearing 156 with axis XX' and an open slot 157 perpendicularly to plane P, two flat and parallel magnetizable metal pieces 158, 159.

and two permanent magnets 188, 189 which connect together magnetically and mechanically for example by bonding the pieces 158, 159, 155, the distance between pieces 158, 159 having a value n greater than the diameter of the coil and less than m or m'.

A plastic material piece 160 having a bore for a bearing 161 and two opposite grooves 162, 163 which are engaged in slot 157 is associated with piece 155 so that bore 161 is located in the axis XX'.

When the magnetizable structure or mobile armature 153 is mounted in the magnetic structure 154, the lower end 149 slides in bore 161 whereas the plastic material extension 120 slides in bearing 156.

Piece 155 has a lower face 164 with a threaded hole 165 for receiving the screw 166 which holds in position the variable flexibility spring 167 whose ends 168, 169 cooperate with plate 150; this piece 155 also comprises axial centering slots such as 170*a*, 170*b* which are engaged in centering studs of the half case 101*b* such as 171; the walls 172, 173 of the half case serve for laterally positioning the piece 155, whereas wall 174 has openings such as 175 for receiving the studs 139, 140, and for orientating the coil carcase 136.

Sealing of the electromagnet is provided by transverse dividing walls of the half cases 101*a*, 101*b* such as 178, 179; these dividing walls define passages 180, 181 for passing the extension 120 and columns such as 142 therethrough.

Holding of the electromagnet 135 in position is completed by positioning the half case 101*a* which clips onto the other half case by means of hooks and openings such as 176 and 177.

When the half cases 101*a*, 101*b* are assembled together, a protective cover 182 is clipped onto their upper parts for completing the insulation of the coil terminal screws 183 and the switch terminal screws 108 and for holding them in position; an opening 190 through which passes the stud 122 of the cover allows the contact holder 124 to be actuated externally and manually.

Mounting of the electromagnet is made possible because, on the one hand, the distance D is greater than the diagonals g (possibly provided with chamfers 196, 197, 198, 199) and because the distance m of the rectangular plates is less than the distance n.

The choice of these dimensional ratios associated with an appropriate diameter of bore 156 in fact allows the armature 153 and coil 136 to be positioned by a rectilinear movement thereof followed by a rotation of 90° of the armature; it is clear that m' is greater than n.

Once the two structures 153, 154 have been fitted in position, coil 136, 146 and the resilient device 167 form an indissociable sub assembly 135 which may be tested on a test bench or else mounted or replaced in a casing, such as the one which has just been described; final adjustment is provided by positioning the spacer 123.

Finally, the teaching of the prior art, if the space occupied by the electromagnet is of no importance, allows the ends of pieces 24, 25 to be given larger pole surfaces by providing them with extensions bent in the transverse direction.

Figure 18:
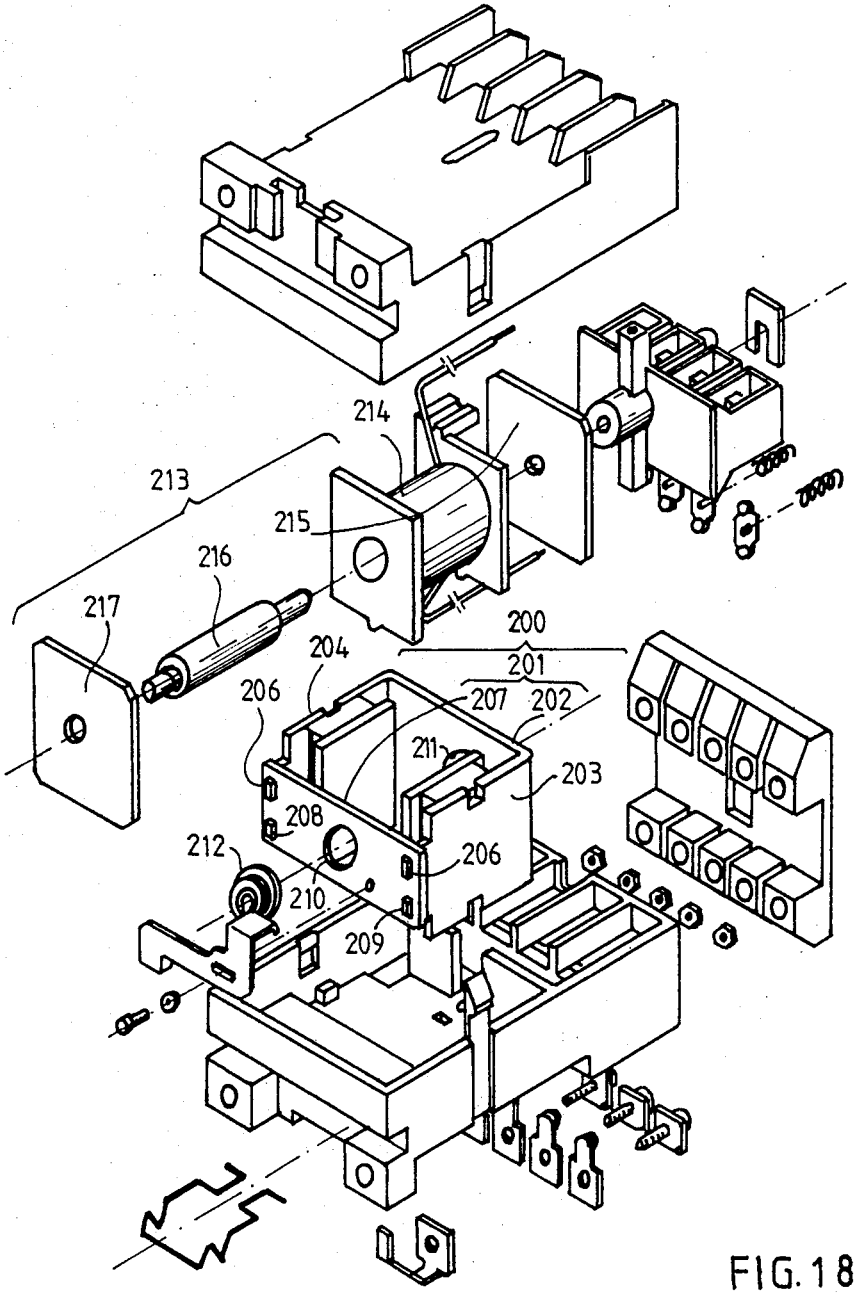

In another embodiment of the electromagnet 200 which is shown in FIG. 18, the frame shaped magnetizable piece 201 comprises two parts assembled together, one of which 202 is in the form of a U piece with parallel legs 203, 204 which have tenons 205, 206 at their ends, whereas the other one is in the form of a plate 207 perpendicular to the legs and having mortices 208, 209, adapted for cooperating with these tenons.

The plate here has a bore 210 which is aligned with bore 211 in the U shaped piece and which receives a bearing 212 made from an antifriction material; a collar of this bearing serves for defining if required the above mentioned air space $d_1$. The coil 214 and the armature 213 of this electromagnet comprising core 216 and plates 215, 217 may be assembled in a way comparable to the preceding one, or by previous assembly of pieces 202 and 213 followed by rivetting the plate 207.

What is claimed is:

1. In a polarized electromagnet comprising:

on the one hand, a first magnetizable structure formed by a core placed longitudinally in the axis of symmetry of a coil adapted for receiving DC current and by two integral widened pole portions which extend transversely outside the coil;

on the other hand, a second permanent magnetic structure formed by a second longitudinal magnetizable piece which has two transverse extensions directed towards the axis and which is parallel to a third magnetizable piece closer to the axis and to which it is connected by a permanent magnet with transverse magnetic axis;

opposite ends of this third piece and regions of these extensions which are adjacent thereto being separated by two air gaps placed substantially along a longitudinal direction so that attraction, respectively repulsion forces in the same longitudinal direction, are developed between each of the widened pole portions placed respectively in each of the air gaps and the second structure, or in one direction when the coil is in a first state or in the reverse direction when the coil assumes a second state;

the improvement is such that:

in the rest position of a first mobile magnetizable structure symmetrical with respect to the axis of the coil, the widened pole portions do not come into contact with the second symmetrical magnetic structure, the partial reluctance established between a first widened pole portion and the third pieces is greater than the partial reluctance established between the second widened pole portion and the second piece of the second structure so as to form an overall reluctance at rest, these two partial reluctances are adjusted simultaneously by means of a member for adjusting the air gaps which defines, through a small relative movement of the two structures, the effective rest position in which movement of the mobile structure takes place, when the coil is supplied with the rising voltage.

2. The polarized electromagnet as claimed in claim 1, wherein said adjustment member bears on the case containing the fixed structure of the electromagnet and causes a slight movement of the mobile structure.

3. The polarized electromagnet as claimed in claim 1, wherein the adjustment member bears on the case containing a fixed sliding structure and causes a slight movement thereof which takes place against the action of resilient means.

4. The polarized electromagnet as claimed in claim 1, wherein the adjustment member is formed by a removable spacer which bears on the case and on one of said structures.

5. The polarized electromagnet as claimed in claim 1, wherein said adjustment member is formed by a stop which is progressively mobile with respect to the case in which it is engaged.

6. The monostable polarized electromagnet as claimed in claim 1, wherein a variable slope device develops directly or not between said two structures and in the vicinity of the working position, an axial force antagonistic to that which is established between said structures by the permanent magnetic attraction so as to compensate for this latter when the coil is not supplied with power.

7. The monostable polarized electromagnet as claimed in claim 6, wherein said device is a helical spring, the deformation of which modifies the useful length by its turns coming to bear on a stepped surface.

8. The monostable polarized electromagnet as claimed in claim 6, wherein said device has a characteristic comprising a zero slope portion which results from the presence of a free travel and at least one positive slope portion.

9. The monostable polarized electromagnet as claimed in claim 8, wherein said device uses a resilient blade which is placed between the case and the permanent magnetic structure on the side concerned by the working position of said first widened pole portion.

10. The monostable polarized electromagnet as claimed in claim 8, wherein said device uses a resilient blade fixed externally to the permanent magnetic structure on the side concerned by the working position.

11. The monostable polarized electromagnet as claimed in claim 10, wherein said amagnetic resilient blade has two flexible arms of different elasticities and two ends directed towards the first widened pole portion, a common fixing point allowing the length ratio of these arms to be modified in the transverse direction.

12. The monostable polarized electromagnet as claimed in claim 1, wherein, in the working position of said mobile magnetizable structure, said widened pole portions are separated from the fixed magnetic structure by air gaps whose dimensions are simultaneously provided by an amagnetic intermediate piece of an amagnetic guide bearing placed in said fixed structure for guiding the axial movements of said mobile structure, the overall reluctance in the working position resulting from these air gaps and from the surfaces which define them being chosen with respect to the overall reluctance at rest so that the property of monostability depends solely on the ratio of these two reluctances.

13. The monostable polarized electromagnet as claimed in claim 6, wherein, in the working position of said mobile magnetizable structure, said widened pole portions are separated from said fixed magnetic structure by air gaps whose dimensions are simultaneously provided by an intermediate amagnetic piece of a bearing placed in said fixed structure for guiding the axial movements of said mobile structure, the overall reluctance in the working position, which results from the size of these air gaps and from the values of the surfaces which define them, being chosen with respect to the overall reluctance at rest so that the property of monostability depends, on the one hand, on the ratio of these two overall reluctances and, on the other, on the presence of a resilient return device which is effective in said working position.

14. The monostable polarized electromagnet as claimed in claim 13, wherein the dimensions of said air gaps are simultaneously determined by a collar of a guide bearing which is placed on the working position T side in said fixed structure and between this latter and said mobile structure for providing at least partially axial guiding of the movements of said mobile structure.

15. The polarized electromagnet as claimed in claim 1, wherein, in the rest position of said mobile magnetizable structure, a resilient device develops between said structures a force antagonistic to the magnetic holding forces, said device being effective only over a small travel portion adjacent said position and being disposed externally to said fixed structure.

16. The polarized electromagnet as claimed in claim 1, wherein the second magnetizable piece of said second magnetic structure is formed by a bent rectangular metal frame having two opposite coaxial bores each adapted for holding in position a guide bearing for the axial movements of said mobile structure, one of said bearings being held in a side opening aperture of said second piece.

17. The polarized electromagnet as claimed in claim 1, wherein the second magnetizable piece of said second magnetic structure is formed by the association of a main flat piece bent into a U, the ends of the parallel legs of which are fitted into another flat transverse flux closure piece, said main and closure pieces each comprising an opening adapted for forming, respectively holding in position, a bearing for guiding the movements of said mobile structure.

18. The polarized electromagnet as claimed in claim 1, wherein widened pole portions or plates rectangular in shape have, on the one hand, sides, in which one of these sides is less than the minimum internal distance of the permanent structure and, on the other hand, a diagonal less than the minimum internal distance of said structure.

19. The polarized electromagnet as claimed in claim 1, wherein said mobile structure comprises a cylindrical core placed in the carcase of the coil and a widened pole portion coming into position between two longitudinal columns of this carcase so as to give a given angular orientation to said structure.

20. The polarized electromagnet as claimed in claim 1, wherein said fixed and mobile structures and the coil form, once associated, an indissociable electromagnetic actuation sub assembly which may then be handled for testing purposes or for direct fitting in a case.

21. The polarized electromagnet as claimed in claim 20, wherein said actuation sub assembly is placed in a contactor case having first holding means which cooperate with second holding means placed respectively on said fixed structure and respectively on the carcase of said coil.

22. The polarized electromagnet as claimed in claim 1, wherein said contactor has a mobile contact holder, a cylindrical portion of which opposite the contacts is fitted onto an extension of said mobile structure, said portion partially providing the function of axial guiding of said structure by sliding in an axial opening of said fixed structure.

* * * * *